United States Patent [19]

Leslie et al.

[11] 4,186,632

[45] Feb. 5, 1980

[54] CUTTING SYSTEM FOR SLAB-TYPE MATERIALS

[75] Inventors: Elmer N. Leslie; Bobby Higgins, both of Dallas; Joe T. Huff, Garland, all of Tex.

[73] Assignee: Camsco, Inc., Richardson, Tex.

[21] Appl. No.: 922,703

[22] Filed: Jul. 7, 1978

[51] Int. Cl.[2] ..... B26D 5/00

[52] U.S. Cl. ..... 83/13; 83/71; 83/925 CC

[58] Field of Search ..... 83/13, 71, 925 CC, 36 E

[56] References Cited

U.S. PATENT DOCUMENTS

| | | | |
|---|---|---|---|
| 3,769,488 | 10/1973 | Hasslinger | 83/925 CC X |
| 3,864,997 | 2/1975 | Pearl et al. | 83/925 CC X |
| 3,887,903 | 6/1975 | Martell | 340/706 X |
| 3,931,501 | 1/1976 | Barr et al. | 83/71 X |
| 4,011,779 | 3/1977 | Berg | 83/71 |
| 4,112,797 | 9/1978 | Pearl | 83/925 CC X |

*Primary Examiner*—Frank T. Yost

*Attorney, Agent, or Firm*—Richards, Harris & Medlock

[57] ABSTRACT

A cutting system for slab goods is disclosed. The system has three stations operating under computer interface control. In a first station, slab goods, such as synthetic shoe bottom materials and the like, are sequentially loaded for purposes of measurement. At the measuring station, the material is loaded on a slab-by-slab basis, and for each slab of material, a series of measurements are made to determine the largest permissible rectangle for that irregular piece of material. The dimensions are fed to a marker-making system, which, in real time, determines the average of usable material taken from the measurements of all the stacked slabs. A cutting marker is then generated by the marker-making system. The slabs are then moved into the cutting area, utilizing a belt drive upon which the slabs rest in the measurement station. Cutting commences at the cutting station, utilizing a cutting tool mounted on a carriage which traverses that station. A variable hold-down system accommodates different size slabs. When the cutting is complete, material is transported to an off-load station where the cut parts are removed from the system. Flowthrough is achieved by having three discrete stations working independently such that, for example, while measuring is taking place at the measure station, cutting may simultaneously occur at the cutting station and prior cut goods being off-loaded at an off-load station. Additionally, multiple cutting systems may be controlled by a single marker-making system.

18 Claims, 13 Drawing Figures

FIG. 1
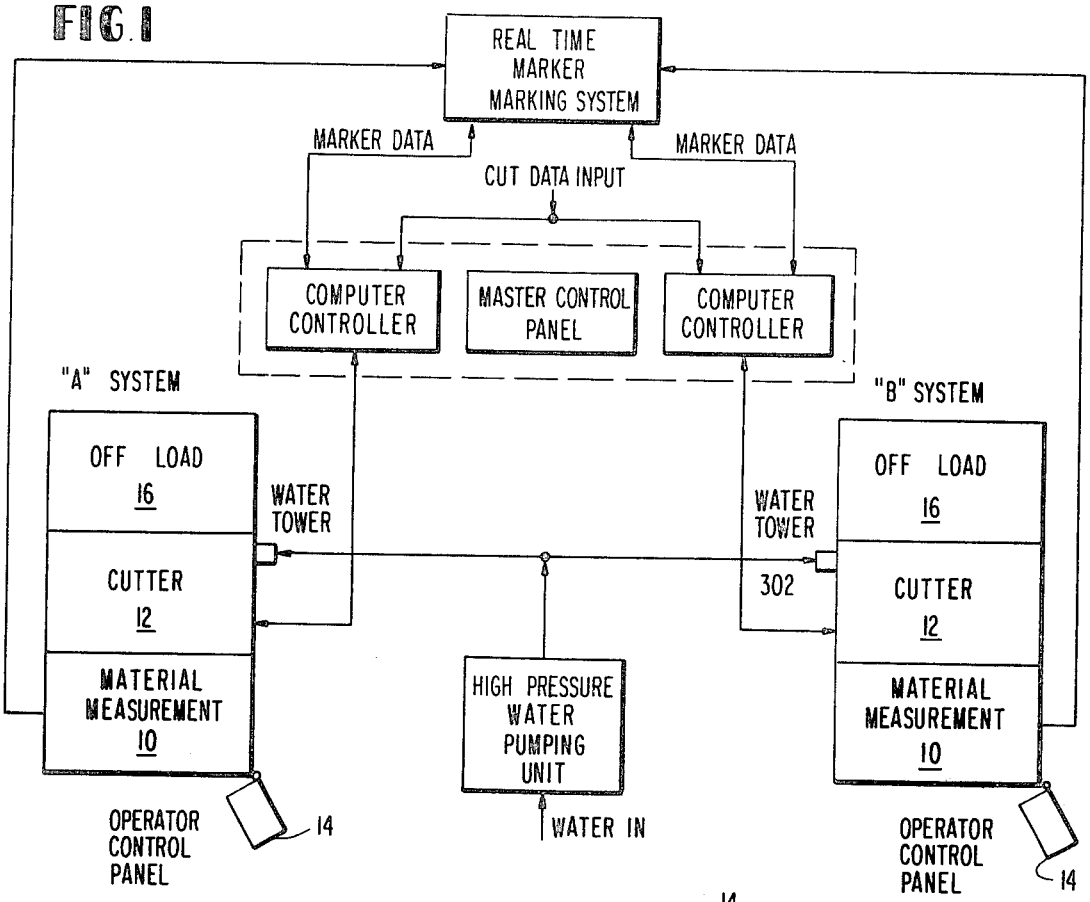
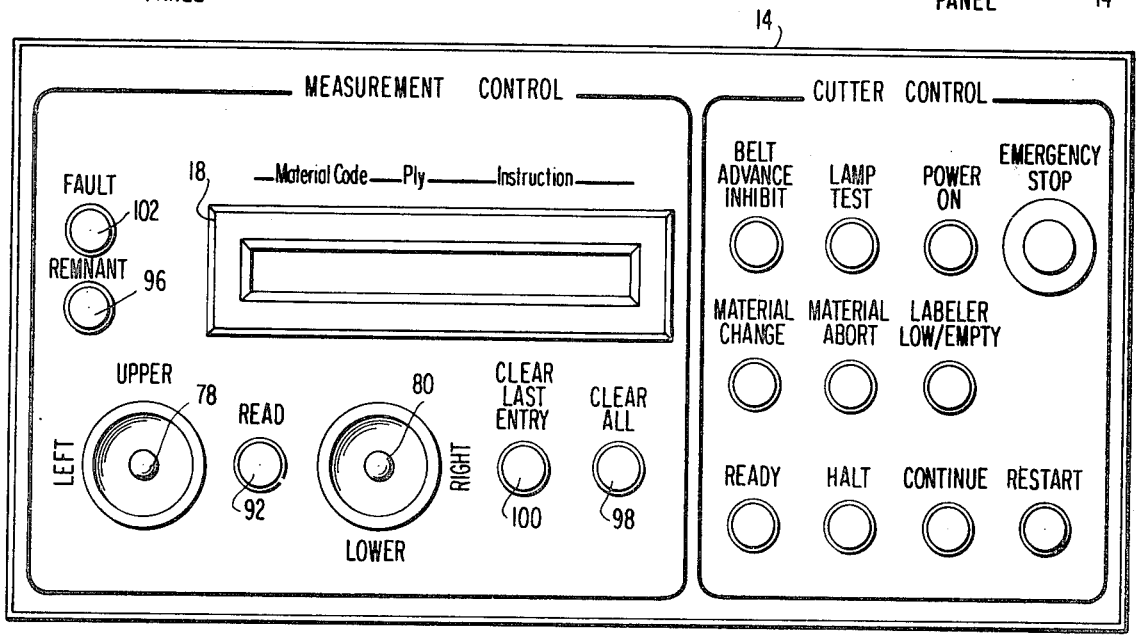
FIG. 4

90
372

CUTTING SYSTEM FOR SLAB-TYPE MATERIALS

BACKGROUND OF THE INVENTION

This invention relates to a cutting system for cutting slab goods.

Cutting systems utilizing sophisticated computer control have been used to perform intricate cutting operations based on pre-loaded data which controls the direction of movement of a cutting tool. Typical systems have used a carriage which traverses a cutting station in one direction carrying on it a cutting tool which moves in an orthogonal direction to the carriage. By coordinated movements of the cutting tool and carriage, complex shapes may be cut.

This technique of cutting is well documented in the prior art. For example, U.S. Pat. No. 3,978,748, commonly assigned, shows a fluid cutting jet system having coordinated carriage and cutting tool motions. In the context of torch cutting machines, U.S. Pat. No. 2,336,596 is a representative system showing movement of torches in a tracing movement across a cutting table. A sophisticated cutting system utilizing fluid jet techniques is also disclosed in the applicants' application Ser. No. 758,368 and now U.S. Pat. No. 4,140,038. That system has specific applicability to the present invention in terms of fluid handling techniques. Still another prior art technique utilizing precise indexing of sheet material in the system is disclosed in U.S. Pat. No. 3,844,861.

These prior art cutting systems generally share a common trait in that continuous or roll goods are used as the input material for cutting. That is, in the prior art, materials to be cut generally have uniform parallel longitudinal edges. They may be fed across the table and maintained in an accurate registration utilizing a variety of techniques. For example, in the U.S. Pat. No. 3,844,861, the roll goods are continuously fed off of a storage or supply spool and are pulled across the cutting surface by means of the carriage. Since the carriage is under computer control and its drive system determines accurately the position of the carriage vis-a-vis the cutting table, accurate registration of materials in the cutting area can be attained. Moreover, in a variance of the basic technique disclosed in the U.S. Pat. No. 3,844,861, registration can further be enhanced by having a series of sprocket holes disposed on the longitudinal peripheral edges of the material to be cut or otherwise worked upon.

In the case of techniques utilizing flame cutters, similar registration is maintained because the work piece has parallel longitudinal edges and is either of a known rectangular shape or fed continuously from a supply having uniform work blanks. Typical are the systems disclosed in U.S. Pat. Nos. 3,866,892 and 2,345,314.

A variation is shown in the commonly-assigned U.S. Pat. No. 3,978,748. That patent shows the technique of handling continuous or roll goods across the cutting table by means of a feed belt at the input side of the cutting station. U.S. Pat. No. 3,978,748 also shows the use of trays for loading of materials into the cutting area. U.S. Pat. No. 3,978,748, however, is silent concerning problems of material registration and measurement as a precursor to a precision cutting operation.

This invention is directed to the problems associated with the handling and cutting of slab goods. These goods, such as hides, synthetic shoe bottom materials and the like, are generally of random size. In the case of slab goods, the individual sheets are generally not formed as rectangles or other regular blank sizes. The slab goods are generally received for cutting with only rough edge treatment such that no uniformity between various sheets is present. Accordingly, the usable area will vary between individual sheets of slab goods.

In order to productively cut these materials with a maximum utilization of material, a system must take into account the maximum usable area on each slab so that in the production of a marker, material usage will be maximized.

Moreover, multiple plies of slabs will generally be cut at the same time so that, when overlying each other, the same cut will generate a multiple number of parts. In the case of cutting multiple plies, added system capability is mandated to generate the maximum usable area for the slab stack. Then, a cutting marker is produced which will provide maximum material utilization over the range in dimensions of each of the slabs.

The technique for marker making in the context of computer operations is disclosed in commonly-assigned U.S. Pat. No. 3,887,903. That patent discloses a technique for generating an apparel pattern marker utilizing interactive computer techniques.

In treating slab goods, prior art cutting techniques have been limited to separate measurements which are then fed to an off-line computer station for generating a marker compatible with that individual slab. Techniques of simultaneous cutting of multiple slabs have not generally been efficient in maximizing raw materials or throughput. Alternatively, the prior art has not used computerized marker techniques with slab goods but utilizes die cutting and the like to attempt maximum slab utilization. In the context of systems which cut, for example, a shoe sole, reduction of waste material is of crucial importance. The cost of such materials, for example, leather hides or composite shoe sole bottoms, makes it mandatory that efficiency of materials is maintained to a maximum. Hence, computerized techniques for generating markers and grading for sizes have attained commercial significance in such raw materials. However, the use of such a marker for multiple slabs or real time operation has been the subject of continuing research.

A proposed system using an off-line marker maker is disclosed in "Automation in Cutting Shoe Components," Volume 24, British Boot and Shoe Institution, May/June 1978. That system, using a die cutter, employs sections for measurement, cut and off-load. Measurements of a single slab are made and manually entered into an off-line marker maker. The marker is generated while the knife is loaded, and the single ply is then cut. The system does not measure multiple plies, and the marker maker is not suitable for multiple ply optimization. Moreover, measurements are not automatically transferred to the marker maker. Although throughput is increased, the system is limited to die cutting. Registration of the slabs between the measuring and cutting stations is not considered since an X-Y cutting system is not used. Also, the marker maker is limited to the cutting of a size specified in the die and cannot, on one ply, cut a multitude of different shapes. Hence, the proposed system does not achieve the necessary level of efficiency to make it commercially attractive.

Another problem in prior art techniques utilized in cutting slab goods has been the problem of maintaining adequate throughput in the machine. As previously indicated, one prior art technique is to generate on an off-line basis a separate marker which is then fed into the cutting system as a set of instructions to govern cutting operation. However, system delays while the data is entered and the marker is being generated reduce throughput of the machine. Accordingly, a need exists within this technology to provide a system which has compatible measuring and marker generation compatibility. Stated slightly differently, throughput in the machine can be improved if the marker can be generated on a real time basis following measurements of individual slabs.

Another problem with the prior art in terms of maintaining throughput in a cutting system has been the requirement that the slabs be physically transported from a measuring station which is remote from the cutting station. Hence, at one point in the system, slab area is determined by measurement, and the marker is laid out. The slabs must then be transported to a cutting system, placed on the cutting bed, and once positioned, the cut sequence can then begin. Obviously, delays in cutting are inherent because the system is dependent on individual handling techniques. Inaccuracies also result due to misalignment of the material to be cut on the cutting surface.

Moreover, in devices where belts are used to physically move the slab goods into the cutting area, the problem of accurate registration remains. That is, although the goods are physically measured in one station, unless they can be aligned in the cutting station with precision, the generation of the marker will not correspond to the position of the slab goods vis-a-vis known locations in the cutting area. Hence, for real time throughput, a requirement still exists that the goods once measured be properly moved and aligned in the cutting station such that compatibility of measuring points is maintained.

Yet another problem in the prior art is that of holding down the slab goods as the cutting sequence commences. In the context of roll goods, techniques such as clamping at end points in the cutting area are commonly utilized. Clamping or otherwise holding the materials in the cutting area, for example, by vacuum hold-down techniques, allows the length of continuous roll goods to be held in place while the cut sequence commences. However, in dealing with slab goods, as previously indicated, unequal lengths and widths are commonplace. Hence, the use of stationary clamps is not feasible because, in many cutting operations, the slabs themselves will not reach the fixed position of the clamps at the extreme ends of the cutting table. Hence, a requirement exists that some technique be devised for holding down materials of varying sizes in the cutting area.

SUMMARY OF THE INVENTION

Accordingly, it is an object of this invention to define a cutting system which has coordinated material measuring and cutting stations.

It is another object of this invention to define a system having a measuring station for the measurement of slab goods providing measurements for the real time generation of a marker.

Yet another object of this invention is to define a system which has a computer interfaced measuring station used to control throughput of slab goods for measurement.

A still further object of this invention is to define a system having a technique of material handling for transporting slab goods from a measuring station to a cutting station while maintaining accurate registration of the position of those goods.

Another object of this invention is to define a system having the ability to generate a marker on a real time basis as soon as measurements of the stack of slabs is complete.

A further object of this invention is to define a novel slab good cutting system having material hold-down arms which are adjustable to accommodate various sized slabs.

A further object of this invention is to define a system for measuring critical dimensions in slab goods which are overlaid upon each other in a stack of variable size.

These and other objects of this invention are accomplished by a novel cutting system having three distinct stations. In a first station, the load and measuring station, a cursor frame is used having the dual capability of elevating and tilting to accommodate loading multiple stacks of slab goods. The frame carries four cursors, two in the X direction and two in the Y direction, which are individually controllable used to delineate the outer perimeter boundaries of each slab. By use of encoders, the positions of the cursors are fed directly to a computer for the generation of a marker in real time.

The slabs, when loaded into the measuring station, are placed in accurate registration in one corner on a movable belt. At the conclusion of the measurement step, a marker is automatically generated in real time to direct the cutting operation. The stack of slabs is then fed on the same belt to the cutting station. When positioned in the cutting station, movable bars are lowered to anchor the slabs, and each bar may be moved up and away from the cutting carriage as a cutting operation continues in the vicinity of that hold-down member.

During the cutting operation, a new series of plies are placed onto the load and measure station to have the necessary measurements taken for the generation of the next marker. When the cutting operation is complete, cut parts are fed to an off-load station where the parts may be separated and removed from the system.

These and other advantages of the present invention will become apparent from the description of the preferred embodiment which follows.

BRIEF DESCRIPTION OF THE DRAWINGS

FIG. 1 is a systematic block diagram showing elements of the system used for the control of two cutter subsystems.

FIG. 4 is a top view of the control panel used for control of the cutter system.

FIG. *6a–6d* show schematically the operation of the cursor assemblies.

Figure 7:
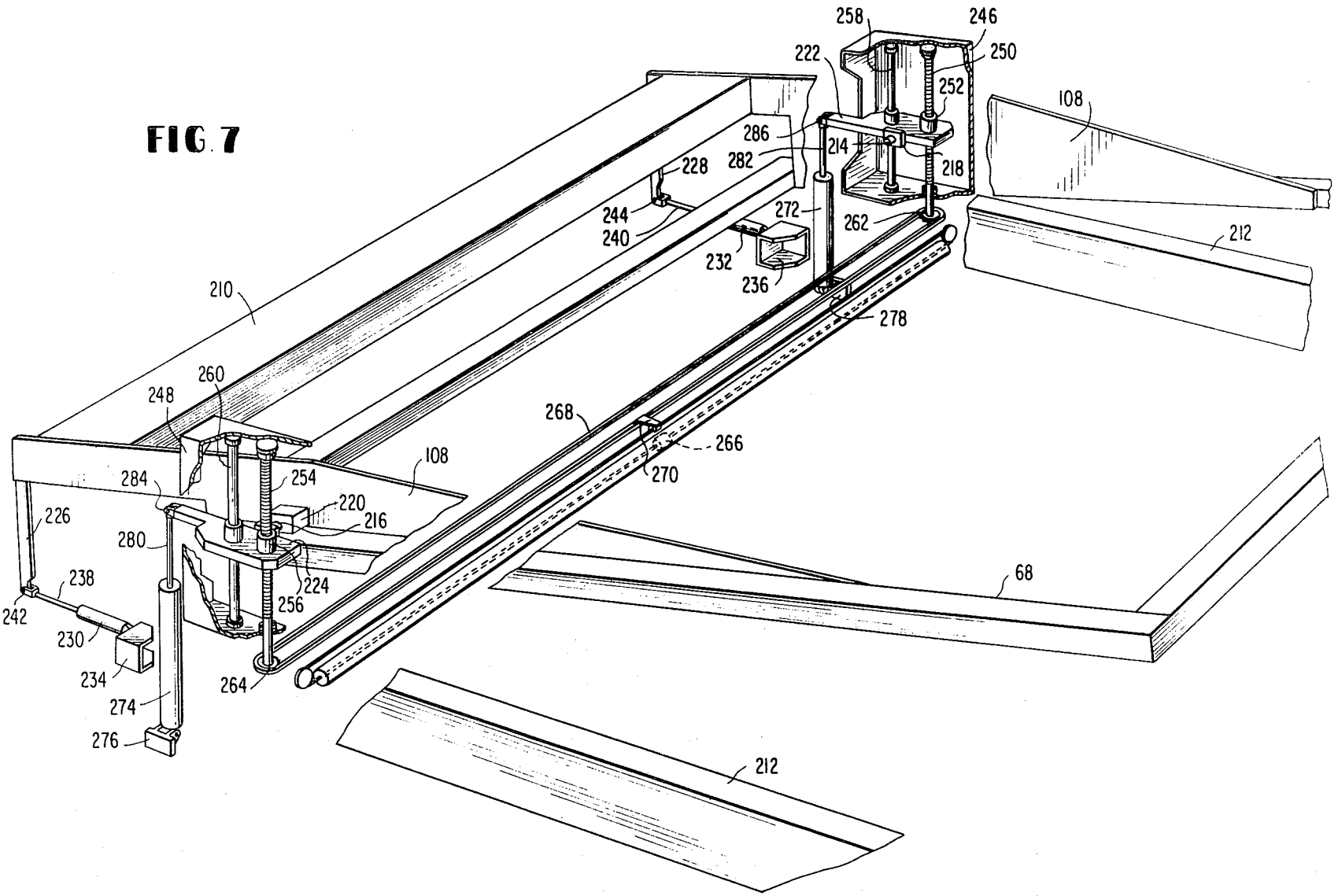

FIG. 7 is a cutaway perspective showing the cursor frame elevation and tilt assembly.

Figures 8, 9, 10:
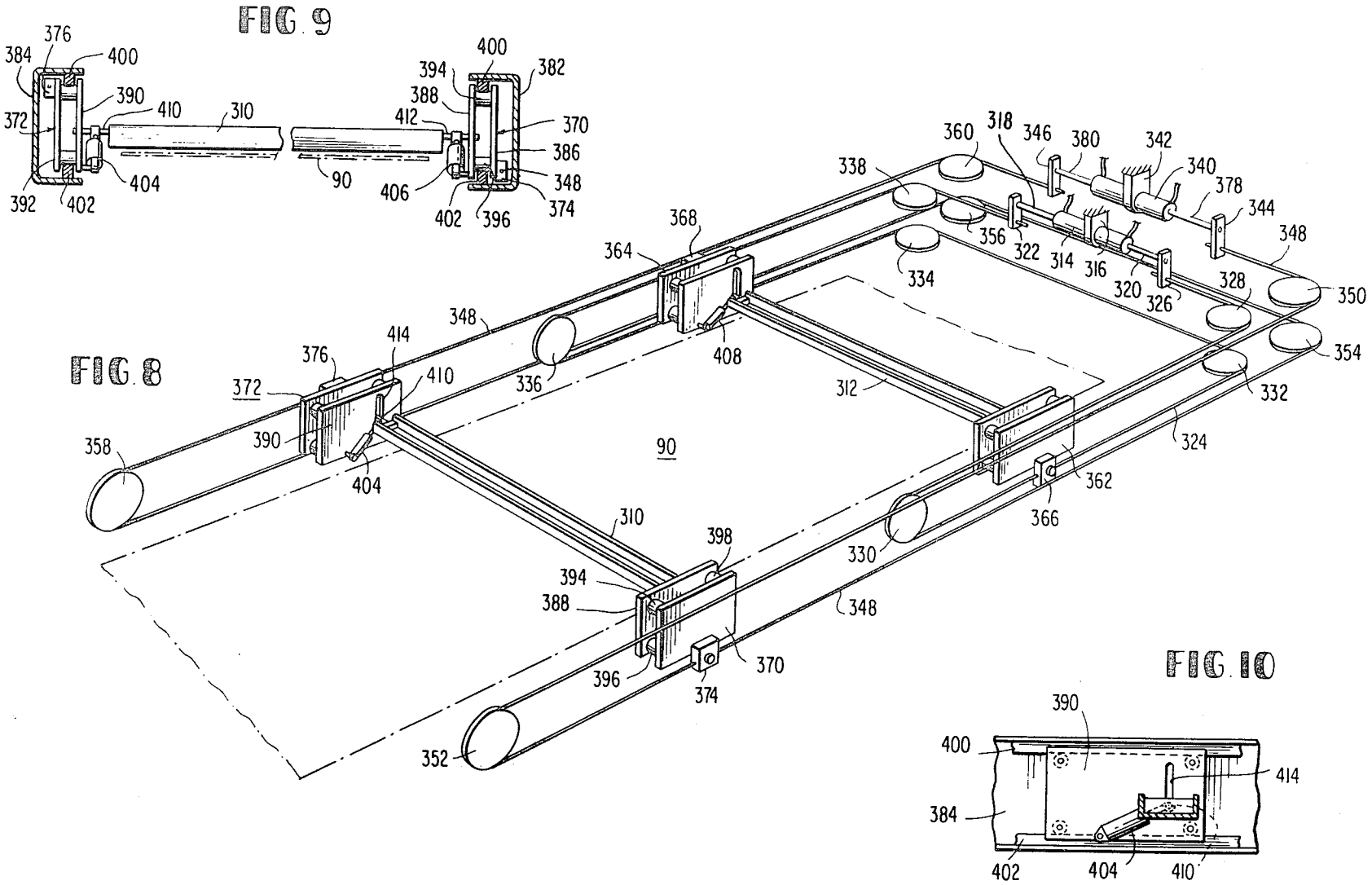

FIG. 8 is a perspective schematic view of the movable arm hold-down assembly.

FIG. 9 is a schematic front view of the material hold-down assembly of FIG. 8.

FIG. 10 is a schematic side view of a car in the material hold-down assembly of FIG. 8.

DESCRIPTION OF THE PREFERRED EMBODIMENT

Referring now to FIG. 1, a systematic hardware configuration for a cutter system in accordance with this invention is shown. Typically, the cutter assembly in the cutter section can be a fluid jet cutter of the type described herein. For example, the cutter assembly may be of the type disclosed in U.S. Pat. No. 4,140,038, issued Feb. 20, 1979 and entitled "Fluid Jet Cutter." As shown in FIG. 1, a central high-pressure water pumping unit is used to generate water pressures in the range of 60,000 psi. A common pumping unit is used to transfer high-pressure water to the cutting station via stainless-steel tubing which feeds water towers on each cutter. That hardware will be shown specifically with respect to FIGS. 2 and 3. It is apparent that while one pumping system is shown for controlling two cutter stations simultaneously, the system is operable for a single three-section system having its own high-pressure water pumping unit.

The system of FIG. 1 shows central computer control for two subsystems "A" and "B". The subsystems are identical and will be discussed in terms of one line. At each subsystem, a material measurement station 10 is provided. The material measurement station is the input section to the system wherein loading of raw material for measurement and the generation of a marker is performed. It will be described in detail relative to FIGS. 2, 3, 6 and 7. This activity is performed while cutting of a previously measured load takes place at the cutter station 12. This operation will be described relative to FIGS. 2, 3 and 8–10. An operator control panel 14 is provided in each subsystem to control the operation of that subsystem. Once the cutter operation has been completed, cut pieces are moved to an off-load station 16 where scrap materal is removed and cut pieces are transferred from the system are for further processing. The operator control panel 14 will be discussed in greater detail with respect to FIG. 4.

The operation of the system is by interactive logic. A first input to the system is "cut data," providing information indicative of scheduled production. "Cut data" includes an identification of the pieces to be cut from the slab goods, labeler information for those pieces, sizes, the type of materials and the number of slabs to be used. This data input is supplied to the computer controllers as shown in FIG. 1 via flexible discs or the like. It is a pre-generated data input for the system. As shown, two computer controllers are used.

A second input to the system is the measurements made by the operator at the measurement station. These measurements, to be described in detail herein, provide the real time marker-making system with data concerning the maximum usable area in each slab. FIG. 1 shows a data input from the measurement station 10 to the real time marker-making system for transmission of this measurement data. As the measurements proceed, the interactive logic provides the operator with instructions displayed on the control panel display 18 (FIG. 4). The program providing this interface is loaded into the computer controller, such as an HP-2105 computer with 16,392 words of memory. It is readily apparent that a number of equivalent mini-processors can be used.

As shown in FIG. 1, measurement data is supplied from the material measurement section 10 to the real time marker-making system. This data comprises the dimensions of the plies as measured. Another data input is supplied from the computer controller in the form of cut data information. The marker-making system, typically an HP 21X with an HP 7905A disc, will generate the marker on a near real time basis as the slabs are transported to the cutter section 12 on belt 20. The real time marker-making system has the capacity to serve two cutting subsystems, as shown. It could, however, be dedicated to a single line.

As indicated, measurement of one pile of slabs takes place a slab at a time in response to predetermined cut pieces to be produced. Interface of measurement data to cut data is therefore required so that the marker generated is properly used with the cutter program selected. Also, as shown in FIG. 1, one marker-making system serves two parallel stations. Selection of the proper system to perform the cutting tasks is accomplished by means of a program. The computer controllers each directly control the motion of the cutting beads. In the preferred embodiment using a fluid jet, generation of motion in X-Y coordinates to effectuate complex cutting paths is accomplished by a program.

The interactive logic uses a principle output point at the operator control panel 14. During the measurement cycle, the panel uses a display 18, shown in FIG. 4, having three separate display sections.

The first is a material code output which provides to the operator a code indicative of the type of material—that is, the type of a slab good to be loaded. The second displayed output is the number of plies—that is, number of stacks of slabs that are to be loaded into the material measurement section 10. The third display is the "instruction" display in which the marker-making system will instruct the operator as to the appropriate type of measurement to be made in the material measurement section. When the measurements have been completed for each individual slab, they are transmitted to the marker-making system, and, following the last measurement for the last ply in the stack, the marker-making system will generate a marker for the use of a particular cutter. The marker data will then be transferred to the cutter through the computer controller. Cutting operation will then advance under the control of the computer controller utilizing the generated marker.

In the case of multiple cutting systems, a master control panel is provided to monitor operation of those two systems. Computer controlled cutting is known per se—that is, a computerized control of cutting direction and sequence.

Figure 2:
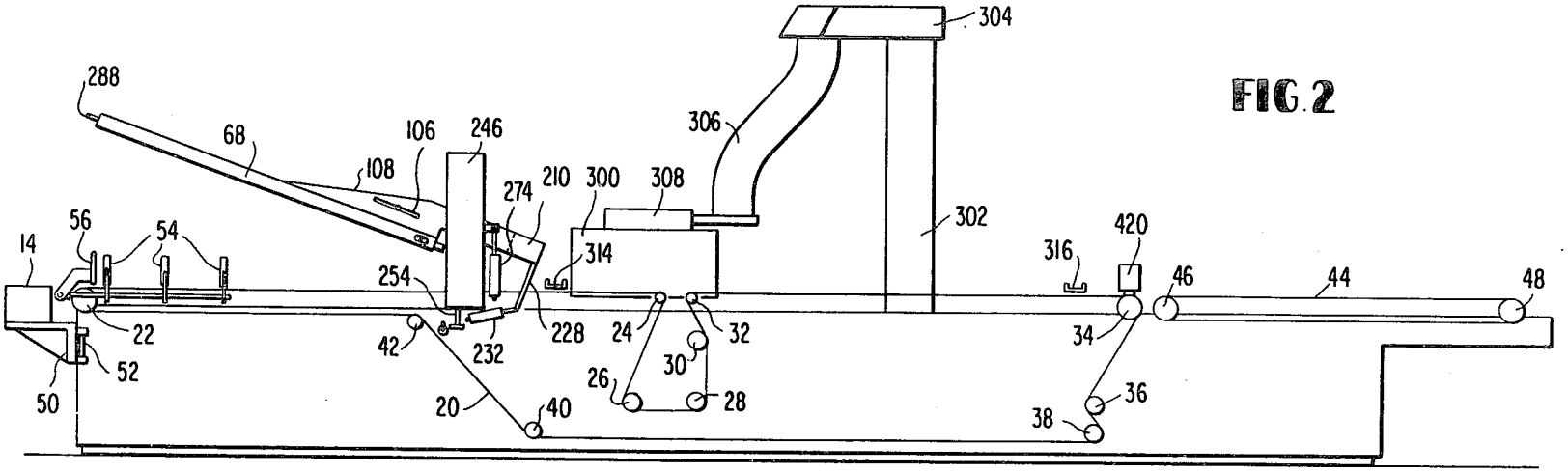
FIG. 2 is a schematic side view of one subsystem having coordinated measurement, cut and off-load capability.
Figure 3:
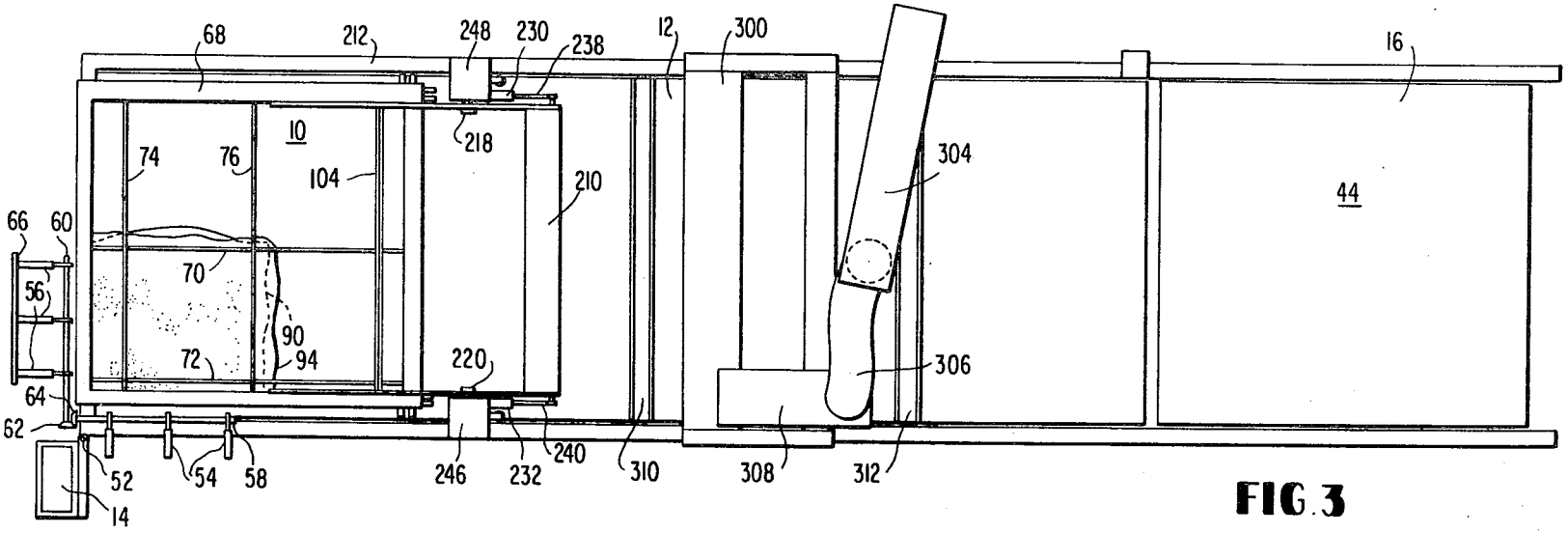
FIG. 3 is a top view of the system shown in FIG. 2.

Referring now to FIGS. 2 and 3, schematic side and top views of the system are shown. As shown in FIGS. 2 and 3, the measurement section 10 and cutter section 12 have a common drive belt 20 for the transport of material from the measurement section 10 to the cutter section 12. The drive belt 20 is in the form of an endless belt formed about pulleys 22–42. Pulley members 24–32 form a recess in the cutter section which, when the belt 20 is clamped, traverses across the cutting area to provide a movable slot for the jet catcher if a fluid jet cutting system is used. The description of this endless belt concept in fluid jet cutting is described in U.S. Pat. No. 4,140,038. The endless belt 20 serves to hold material in position in the measurement section 10, and once measurements are complete, move that material in an accurate manner into the cut section 12. A separate off-load drive belt 44 on drive rollers 46 and 48 is provided for the off-load section 16.

In the measurement section 10, disposed in one corner as shown in FIG. 3, an operator's console, shown in detail in FIG. 4, is positioned. The console 14 is pivotably mounted on frame member 50 about pin 52 such that it may rotate to a convenient position for use by the operator.

Plies of material are loaded onto the measurement section 10 and the dimensions of each ply are measured by the operator based on instructions provided him by the measurement control section of panel 14. The operator loads a slab of material into the load area with the corner of each slab placed in the lower right-hand corner against alignment pins 54 and 56. The alignment pins are rotatable on shafts 58 and 60 and are coupled together by means of two bevel gear elements 62 and 64. By rotation of handle 66, pins 54 and 56 may be selectively moved into an operative vertical position shown in FIG. 2 so that slab goods will abut against those pins. The lower right-hand corner with the reference pins 54 and 56 thus defines a 0—0 position for subsequent measuring. As plies are stacked in the measurement section 10, each is positioned with corners abutting against pins 54 and 56. When the operator has loaded a slab of material in the cutting area, he removes the alignment pins and then moves the material measurement frame 68 down into position. Rotation also initiates a vertical downward movement to evenly lower the frame over the material. This rotation plus uniform vertical downward movement will be discussed in greater detail with respect to FIG. 7 which shows the elements which accomplish the coordinated movement of the frame 68 over the material.

The measurement frame 68 has four cursors which are located within each frame. The cursors are arranged with two X direction cursors 70 and 72 and two Y direction cursors 74 and 76. By use of control elements 78 and 80, as shown in FIG. 4, movement of the cursors is accomplished.

The cursors are aligned individually to the edge of the material without overlapping the edge of the material at any point.

Each control handle 78 and 80 (FIG. 4) performs a "joy stick" operation of two cursors. Each handle is spring loaded to null at a center location, and, by movement, will change position of a potentiometer associated with a particular motor drive for a cursor. For example, with respect to control knob 78, up/down motion will drive cursor 76 through motor 190, and side motion will drive the "left" cursor 72 via motor 134. Hence, by actuating the handle 78, up and down movement of the handle 78 will effectuate movement of the cursors 72 and 76. Motion of both cursors can be effectuated by diagonal movement of the joy stick. Correspondingly, handle 80 will effectuate movement of the "right" and "lower" cursors 70 and 74 via motors 112 and 158. The operation of these cursors will be explained in greater detail in conjunction with FIGS. 5 and 6.

As shown in FIG. 3, a first ply, for example, a lower ply 90, is placed in the lower right-hand corner with alignment bars 58 and 60 in position to receive the material. After placement in the lower right-hand corner, the alignment bars are rotated out of position by means of handle 66, and the frame 68 is moved downward over the ply. By appropriate movement of the cursors 70–76, dimensions are ascertained by means of encoders associated with each cursor drive. At this point, a "read" button 92 on the control panel 14 is depressed, and the dimensions are fed to the real time marker-making system. The system continuously scans the "read" button 92, and data outputs from encoders associated with the cursors 70–76 are masked until the button 92 is depressed. At that time, the output of the four encoders is fed to the marker maker providing data as to slab size.

Figures 5, 6A, 6B, 6C, 6D:
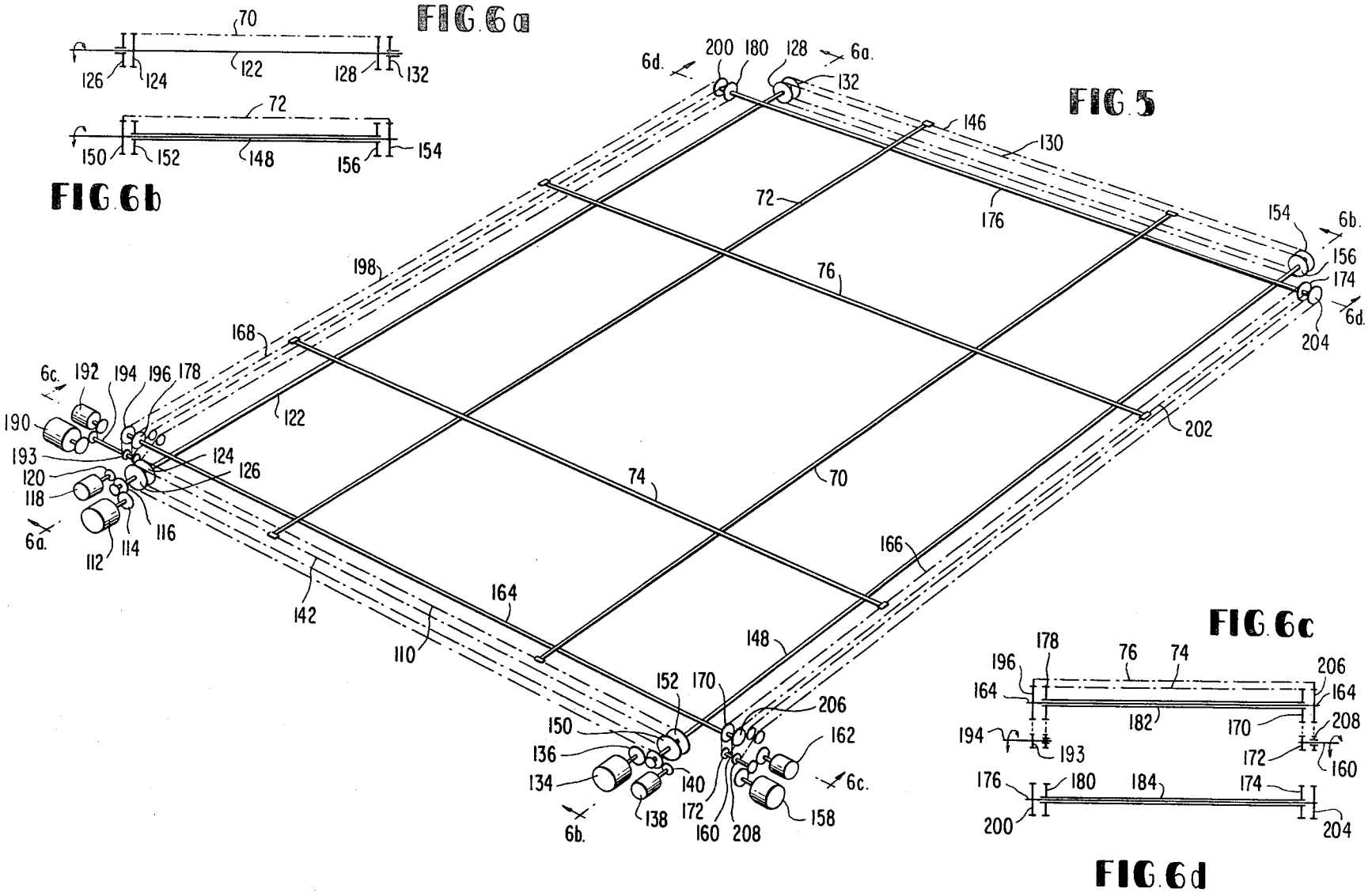
FIG. 5 is a perspective view of the cursor measurement structure.

Each cursor 70–76 discused with respect to FIG. 5 is independently addressed by the real time marker maker. Hence, one depression of "read" causes four distinct inputs to be read into the system. If the marker-making system is performing another task, for example, generating the marker for the other parallel system, the read function is delayed until that task is complete. The marker-making system will provide a signal, indicating that the read data has been received so that the next ply can be loaded or other function performed by the operator. For example, a one-shot multivibrator in the control panel 14 can deliver an audio tone. When this signal is delivered, the operator moves to the next operation. If the instruction display calls for another ply, the frame 68 (FIG. 2) is lifted, and alignment pins are rotated into position by means of handle 66. A second ply 94 (FIG. 3) is then overlayed onto ply 90, and the operation repeated until the correct number of plies has been loaded.

As shown in FIG. 4, in addition to the "read" switch 92, other control switches are included for use of the operator. A "remnant" switch 96 is provided which signals the computer marker-making system that an irregularly-shaped piece of material, for example, a L-shaped material, is to be measured and an appropriate marker is to be generated.

A "clear all" button 98, when depressed, allows the operator to begin a set of material measurements for a given ply of material. Depression of the "clear all" button 98 allows the operator to start a sequence of measurements completely for a new ply if some previous measurements have been in error or are otherwise unusable. A "clear last entry" switch 100 is used to clear only the last previous measurement entry so that an individual measurement may be retaken and supplied to the computer.

When each of the plies for a given cut has been measured, the marker system in the computer will compute the largest rectangular shape that can be cut in the ply stack without overlapping the edge of any of the material slabs in the ply. This rectangular shape will then form the basis for generating a marker for that particular cutting operation which will commence. Also, within the measurement control section of panel 14 is a "fault" indicator 102 which shows that a system malfunction has occurred which is defined on the control panel display, and, additionally, if necessary, on the system console. Typical are loss of oil or air pressure or labeler malfunction.

To aid in aligning the cursors, particularly the cursor 76, with the rear edge of the slab, a mirror assembly 104 is provided to eliminate parallax errors. The mirror 104 is adjustable within slot 106 on brace member 108 to angularly adjust the position of the mirror for maximum visual alignment of the cursor 76. Hence, with the measurement frame 68 in the down position and the operator standing at the end of the machine operating the control panel 14, a visual sighting of the position of cursor 76 relative to the upper edge of a ply can be maintained.

Referring now to FIGS. 5 and 6, the details of the cursor frame assembly are shown. The first cursor in the X direction, cursor 70, is driven along a micro-chain drive 110 by drive motor 112. Drive motor 112 has an output shaft 114 feeding gear train elements 116. Associated with the gear train output element 116 is an encoder 118 which is driven by gear member 120 operably coupled to output gear section 116. The output of encoder 118 produces an input to the computer relative to the position of cursor 70.

As shown in FIG. 6*a*, gear member 116 is coupled to shaft 122, having an output pulley 124 associated with it. Rotation of shaft 122 will effectuate a corresponding movement of pulley 124. As will be explained herein, a second pulley member 126 is free-wheeling on shaft 122. To accomplish uniform movement of cursor 70, pulley member 128, disposed on the opposite side of the frame, drives chain element 130 to which the cursor 70 is attached as shown. A second pulley member 132 associated with cursor 72 free-wheels about shaft 122. Accordingly, as can be seen from FIG. 6*a*, rotational movement by drive motor 112 will create an output rotation about shaft 122. Coupled to that shaft in a direct drive relationship are pulleys 124 and 128 which drive in a precision manner micro-chain elements 110 and 130, thereby driving cursor 70 in the X direction.

In a corollary manner, the second X position cursor 72 is driven by motor 134 through gear section 136. An encoder 138 having a gear element 140 is operably disposed to pick off movement of gear element 136 and provide an indication of the position of cursor 72. Cursor 72 is driven by two micro-chain strips 142 and 146. The output of gear section 136 is fed to shaft 148, having pulley 150 directly driven by the output of shaft 148. A second pulley 152 provides the return path for micro-chain 110 which is driven by pulley 124 and, therefore, as shown in FIG. 6*b*, free-wheels about shaft 148. In a corresponding manner at the upper end of the measurement frame, pulley section 154 is driven by shaft 148 while a second pulley 156 free-wheels to provide a return path for micro-chain 130. The return path for micro-chain 146 is provided by pulley 132 free-wheeling on shaft 122, and the return pulley for micro-chain 142 is provided by pulley 126 free-wheeling on shaft 122. Accordingly, by the arrangement of free-wheeling and driven pulleys, independent movement and sensing of cursors 70 and 72 is effectuated.

In the Y direction, cursors 74 and 76 are driven in a nearly similar manner. The first Y-direction cursor 74 is driven by motor 158 having an associated output gear mechanism 160 and encoder 162. In a manner consistent with the X direction encoders, Y direction encoder 162 accurately picks up the position of cursor 74. The output of gear train 160 is used to drive pulleys 170 and 172, thereby turning the micro-chain 166 to provide movement of one side of the cursor 74. As shown in FIG. 6*c*, the output of shaft 160 is directly coupled to pulley 172. The micro-chain 166 engages pulley 172 for a direct drive and also engages pulley 170 which free-wheels about the shaft 164.

Return pulley 174 free-wheels about axis 176 to provide a return free-wheeling path for micro-chain 166. Corresponding movement for micro-chain 168 to provide a coordinated movement of cursor 74 is obtained by having chain 168 mounted for rotation on pulleys 178 and 180. As shown in FIGS. 6*c* and 6*d*, the pulley 178 is mounted for rotation on the outer concentric shaft 182 in a manner coordinated with rotation of pulley 170 about the same outer concentric shaft. Pulley 180 is mounted for rotation on outer concentric shaft 184 such that a coordinated movement of pulleys 180 and 174 results, thereby providing coordinated movement for micro-chains 166 and 168.

Motion of the second Y-cursor 76 is provided in a roughly analogous manner. Drive motor 190 and associated encoder 193 provide a rotational output to pulley 192 along shaft 194. Pulley 193 is coupled to directly drive pulley 196, as shown in FIG. 6*c*, thereby moving micro-chain 198. The return path for micro-chain 198 is provided by pulley 200 mounted on shaft 176 to provide a coordinated movement of that micro-chain. The corresponding micro-chain on the opposite side for cursor 76, chain 202, is driven on one end by pulley 204 also mounted on shaft 176 for coordinated movement with pulley 200. As shaft 176 rotates, pulleys 200 and 204 will rotate in a corresponding manner while the outer concentric shaft 184 will have free-wheeling pulleys 174 and 180 unaffected by rotation of shaft 176.

As shown in FIG. 6*c*, pulley 196 is mounted on shaft 164, and inner pulley 178 free-wheels about that shaft on outer concentric shaft 182. Micro-chain 202 is driven by rotation of shaft 164 via pulley 206. As shown in FIG. 6*c*, the output of shaft 160 free-wheels via pulley 208 such that the output of shaft 160 will not affect the rotation of pulley 206.

Accordingly, as shown in FIGS. 5 and 6, movement of any one cursor drive motor 112, 134, 158 or 190 will produce a corresponding coordinated movement of two micro-chains, thereby driving any one cursor in a uniform manner. Motion of those cursors is sensed by any of the encoders 118, 138, 162 or 192 to produce an output signal to the computer indicative of cursor position in the measurement area.

As indicated, the controls 78 and 80 (FIG. 4) are used to trim potentiometers associated with each drive motor giving them proportional control. The motors are typically O.C. motors driven through a pulse width modulator at 5 kH. If the controls 78 and 80 are centered, a null condition exists such that the square wave input to each motor zeros out. The inherent inertia of the motor prevents incremental motion. As the control is moved, the potentiometer setting moves and the duty cycle is altered. Hence, motor speed and direction is proportional to stick motion. The encoders 118, 138, 162 and 192 are geared to respective motors having 7 mil resolution and providing a 13-bit binary output of absolute position. With a known 0—0 point, cursor movement provides a binary input to the marker maker of exact slab dimensions. Hence, by initial positioning of the slabs and subsequent cursor alignment, the real time marker maker receives an accurate data input.

The cursor drive assembly is contained within frame 68, which, as shown in FIGS. 2 and 3, is movable in a downward direction, both rotating about pin 214 and elevating by means of a screw mechanism shown in FIG. 7. FIG. 7 is an expanded perspective view showing the system which is used to provide a coordinated tilting and elevation movement of the cursor frame 68 over the material in the measurement section 10. Frame 68, as shown in FIG. 3, is generally rectangular in form, having a brace section 108 to operably couple the arm section to a cross member 210. Member 210 acts as a torque box and also serves to house electronics. Counterweighting is done pneumatically by pistons 272 and 274 together with piston elements 230 and 232 to insure that movements of the frame will be gradual, and, even if the frame is released or power fails, it will tend to balance in an equilibrium position. Piston elements 230 and 232 decrease the effective angle that the arm will swing.

Frame 68 is arranged for movement to tilt down and be depressed in a position which is generally parallel to the main frame of the cutting system. This main frame element is shown schematically as element 212. Each brace element 108 is mounted for rotation about pins 214 and 216 in bearing housings 218 and 220. The bearings are fixed in parallel mounting plates 222 and 224 on opposite sides of the frame. The frame elements 108 as shown in FIG. 7 are operably coupled to the counterweight 210 and have at the rearward portions generally vertical arm members 226 and 228.

A pair of pneumatic cylinder elements 230 and 232 have cylinder elements operably coupled to fixed points 234 and 236 which are rigidly secured to the frame member 212. Piston sections 238 and 240 associated with each cylinder section 232 and 234 are coupled to the vertical arm members 226 and 228 by linking members 242 and 244.

As shown in FIG. 7, a coordinated movement of piston and cylinder assemblies 230, 232, 238 and 240 will cause, for example, an extension of piston members 238 and 240 rearwardly to cause the frame 68 to be pivotably lowered—that is, tilted—about pins 214 and 216. An extension of pistons 238 and 240 wll increase the effective length of the pneumatic cylinder assemblies, thereby causing the arm 68 to pivot about the pin members and tilt downward. For upward tilting, it is apparent that the pistons 238 and 240 will be retracted into the respective cylinder assemblies, thereby causing frame member 68 to tilt upward.

Coordinated elevation movement of the frame member 68 is provided by lead screw assemblies as shown in FIG. 7. The lead screw assemblies are operably housed in housing members 246 and 248. Each housing member has an open section disposed inwardly to allow coordinated movement of the plate members 222 and 224 in an upward and downward motion as elevation occurs.

Disposed in housing 246 is a lead screw 250 journaled for rotation in nut assembly 252 operably mounted to the plate 222. A corresponding lead screw 254 is mounted for rotation in nut assembly 256 on plate 224. Guide rods 258 and 260 are also provided to insure that vertical up and down movement occurs and to reduce the torque on lead screws 250 and 254. Suitable end caps are shown within the housings 246 and 248 to provide rotational bearing supports for the lead screws 250 and 254 and to anchor the guide rods 258 and 260.

The lead screws 250 and 254 are mounted for rotation on sprockets 262 and 264 for movement by a double-acting air cylinder 266.

As shown in FIG. 7, the double-acting air cylinder 266 is coupled to a drive chain 268 by coupling member 270 such that movement of the cylinder in either direction will cause a corresponding output on drive chain 268. Lead screws 250 and 254 are of the same sense so that they will be driven together in a coordinated synchronized motion, thereby advancing the nut assemblies 252 or 256 on plates 222 and 224. In this manner, rotation of the lead screws will cause a corresponding upward or downward motion of the plate members 220 and 224 which are anchored to the housings 246 and 248. Hence, as the lead screws advance, the nut assemblies will, by relative movement, move upward or downward on those lead screws, thereby elevating or depressing the cursor frame.

To assist the elevation movement of the cursor frame and dissipate some of the load on the lead screws, a pair of pneumatic cylinder elements 272 and 274 are provided. As shown in FIG. 7, the cylinder elements are anchored to the frame by members 276 and 278 and have the piston elements 280 and 282 operably coupled to the plate members 222 and 224 by a pivotable linkages 284 and 286.

As the lead screws 250 and 254 are actuated, pressure in the cylinders is either gradually increased in the case of an upward elevation, or gradually decreased in the case of a lowering movement to assist in the elevation operation by reducing some of the load on the lead screw and nut assemblies. This coordinated movement, by actuation of the double-acting cylinder 266 with the assist cylinders 272 and 274, is easily accomplished as the operator actuates the frame movement control panel 288 as schematically shown in FIG. 2. This panel contains simple buttons to govern up and down motion of the frame member 68, thereby obtaining a coordinated tilting and elevation movement. For example, once the operator has loaded a slab of material into the measurement area, the frame 68 can be lowered downward over the slab as shown in FIG. 3. The lowering action—that is, the tilting downward—of the frame 68 also initiates a uniform vertical downward movement to lower the frame evenly over the material. The frame does not actually contact the slabs. This eliminates any tendency of the material to bunch up against the alignment pins 54 and 56 as the rearward portion of the frame initially contacts the slab material, tending to urge it to move relative to the measurement surface on belt 20. By initiating a uniform downward movement, the frame is thereby lowered evenly to a position over, but not contacting, the material, alleviating this tendency for movement or displacement of the slab goods.

Referring to FIGS 2–7, the technique of slab good input and initial measurement is readily appreciated. Slab goods, beginning with a first sheet 90, will be loaded onto the belt 20 against alignment pins 54 and 56. Once alignment against those pins has been made, thereby establishing a reference corner, the pins are rotated downward by handle 66 to a position outward of the measurement area. The operator then actuates the control knob on panel 288 to cause frame 68 to be tilted downward and lowered in elevation onto slab 90. Loading of the slab good 90 is done by the operator in accordance with the material code which is set forth on display 18 of control panel 14.

Once the frame 68 is in the lowered position, the operator then systematically initiates a measurement operation using handles 78 and 80 (FIG. 4) to move the cursors 70–76 into positions defining the outward edges of the slab 90. Movement of those cursors is in a manner as defined and shown in FIGS. 5 and 6. When the alignment of all cursors has been made, the "read" button 92 is depressed and the output of all encoders 118, 138, 162 and 192 associated with the cursors 72–76 will be fed to the marker-making system to derive a measurement reading. This measurement will be used to define the maximum area for that particular ply. If reading is in error, the "last clear entry" button 100 can be depressed and the cursor moved to provide a more accurate reading. Should any of the readings for the individual slab be in error, the "clear all" button 98 may be depressed and the cursors realigned for readings of that particular ply. With a particular ply measured, the frame 68 is raised in a manner shown in FIG. 7 and a second ply 94 is positioned over ply 90. Positioning is accomplished in a manner identical for ply 90 by raising the alignment pins 54 and 56 into position to provide the same reference corner. The frame 68 is then lowered, and the measurement sequence commences until the required number of plies as shown in the measurement control section of panel 14 indicates that all plies have been loaded. When final measurements have been completed, the belt 20 is actuated and the stack of plies is moved from the measurement section 10 into the cutting section 12.

Referring now to FIGS. 2 and 3, the details of that cutting section will be explained. As noted herein, a continuous belt 20 is used to feed material from the measurement section 10 into the cutting section 12.

Precision cutting requires that the material be accurately transferred from the measurement section to the cutting section. An encoder (not shown) is positioned on with pulley 22 to provide an accurate indication of belt movement. The encoder typically generates 5000 pulses per revolution. A stepper motor 420 (FIG. 2) is associated with drive pulley 34 to provide accurate belt movement. In the preferred embodiment, the belt advances from the established 0—0 reference position for a stack of slabs 122 inches in 0.003 increments of the stepper motor to advance the stack into the cutting section and to an accurate position without relative movement between the slabs and the belt. Hence, acceleration of the belt must be closely controlled. The computer controller uses pre-programmed ramp data to control acceleration from 0 velocity to 10 IPS, then ramped down through 1 IPS to a stop during the 122-inch travel. The ramp data is experimentally derived to provide the proper acceleration curve to move the belt while not causing relative movement, shifting, of the stack of slabs. Essentially, a predetermined value is loaded into the computer controller indicative of the number of encoder bits necessary to move 122 inches.

The encoder is then counted down, and the output matched to the ramp curve data to provide an output to the stepper motor 420. The encoder provides real time data as to belt movement, and the computer knows how many bits remain until the complete belt advance has been achieved. During the final phase, the belt decelerates to a creep mode, and a decoder is used to trigger this operation. The creep mode may be tuned with adjustable potentiometers depending on slab material to adjust an operational amplifier (op-amp) associated with the stepper motor 420. This can essentially be an integrator current with an RC time constant coupled to the op-amp feedback. The op-amp output is coupled to a voltage control oscillator used to regulate pulse rates supplied to the stepper motor 420.

A gap is formed by rollers 24 and 32 on the carriage 300 to allow a jet catcher to move in the Y direction as the cutting commences. In the preferred embodiment of this invention, utilizing water jet cutting, high-pressure water from the pumping unit is fed to the water tower 302 of the respective cutter which has movable arm 304 feeding the water via a helical stainless-steel coil 306 into a manifold section 308 mounted on the carriage 300. Specific details of this assembly are shown in U.S. Pat. No. 4,140,038. The details of the cutter assembly per se are not crucial to this invention but show one preferred type of cutting system.

The arm 304 mounted on the tower 302 is journaled for rotation such that as the carriage 300 moves back and forth across the cutting section 12, the helical coil 306 and arm 304 tend to follow it in a passive movement. Mounted directly below the manifold 308 on the carriage 300 is a fluid jet cutter assembly which may comprise one or a plurality of cutting heads.

A number of cutting techniques can be employed, although the preferred embodiment uses fluid jet cutting. The technique of holding down the stack of slabs in the cutting area—that is, clamping the stack of slabs to the belt 20—is crucial irrespective of the cutting technique employed. As indicated herein, in the prior art dealing with continuous roll-type goods, clamping at ends of the cutting area are sufficient to lock goods of uniform length onto the cutting surface. This is because the roll goods are generally advanced until they completely cover the cutting area. However, as shown in FIG. 3, the slabs themselves may only comprise a portion of the cutting surface 12, and, accordingly, some technique utilizing a movable hold-down must be required to lock those goods in the cutting area. Also, the hold-down arms must have the ability to move outside of the path of the carriage 300 to allow complete cutting to take place.

For this purpose, a plurality of hold-down bars 310 and 312 are utilized. These bars are shown schematically in FIG. 3 and will be explained in detail with respect to FIGS. 8–10.

Once the plies have been advanced into the cutter area, clamps 314 and 316 (FIG. 2) are lowered to clamp the belt 20 in a lock relationship against the cutting table bed. Clamps 314 and 316 therefore in a locked position define a free length of the belt 20 between those clamp members in which the movable gap formed by rollers 24 and 32 can move. This technique is generally known in the prior art as a technique of utilizing a belt which is held in position during a cutting sequence utilizing a movable carriage.

Referring now to FIGS. 8–10, the details of the variable hold-down mechanism for accommodating slab goods of variable size is shown. During the cutting process in cutting area 12, the conveyor belt is generally very stable and in a clamped position by means of clamps 314 and 316. However, in the case of materials which are lightweight or have a low coefficient of friction between plies, relative movement during the cutting process can occur which would tend to cause a loss in desired cutting accuracy. To prevent this situation from occurring, this invention utilizes a material hold-down mechanism which is shown in FIGS 8–10 and utilized specifically to hold down the stack of slab goods.

As shown in FIG. 8, the material hold-down mechanism essentially consists of two deadweight bars 310 and 312 which are lowered over the ends of the material in the cut area. When necessary, as to be explained herein, the bars 310 and 312 are lifted and moved clear of the carriage to preclude interference with the cutting nozzle. Hence, one bar will always be in contact with the stack of plies. When the belt 20 is advanced, both of the deadweight bars 310 and 312 will be in a raised position.

As shown in FIG. 8, the hold-down bars 310 and 312 are in the form of two independently actuatable systems selectively movable by air cylinders. Associated with bar 312 is air cylinder member 314 which is anchored to the frame 212 of the system by means of anchor member 316. The air cylinder 314 has two piston elements 318 and 320 which are removable in unison—that is, both movable in the same direction. Coupled to piston element 318 is a linking member 322 which is tied to one end of cable 324. The other end of cable 324 is coupled to linking member 326, and the cable is wound about pulleys 328–338.

In a similar manner, the carriage 310 has associated therewith it an air cylinder 340 anchored on member 342 to the frame 212. Two connecting members 344 and 346 couple the pistons of the air cylinder 340 to cable 348. The second cable is wound about pulleys 350–360.

Cable 324 is coupled to car members 362 and 364 associated with the arm 312 by means of lock members 366 and 368. The cable 324 will pass through the lock members 366 and 368 and be affixed thereto in a conventional manner. Similarly, cable 348 is coupled to cars 370 and 372 associated with the bar 310 by means of couplings 374 and 376. For example, if movement of the car 310 was to be initiated, for example, to the right, air cylinder 340 would be actuated to have its associated piston elements move to the right—that is, having piston element 378 move outwardly from cylinder 340, with piston element 380 moving inwardly toward the piston element—to thereby draw the cars 370 and 372 toward the right—that is, in a direction toward the piston elements. Movement in the reverse direction is effectuated by having the piston elements 378 and 380 move to the left, thereby having the car elements carrying bar member 310 move to the left. Corresponding movement utilizing air cylinder 314 associated with cable 324 coupled to cars 362 and 368 is also possible for the hold-down clamp 312.

Referring now to FIGS. 9 and 10, a further description of the operation of the car members and the technique of raising and lowering the bars will be explained.

FIG. 9 shows a cutaway front view of the cutting section with hold-down member 310 and car members 370 and 372. The car members 370 and 372 are constrained for movement in the cutting section in housings 382 and 384 which are disposed in a parallel relationship on the frame of the cutter. The cars 370 and 372 generally comprise two parallel plates 386 and 388 for car 370 and parallel plates 390 and 392 for car 372. Disposed within each parallel plate are a series of rollers 394, 396, 398 and a fourth roller (not shown) for car 370, and a similar series of rollers for car 372. The rollers are disposed in a parallel top and bottom configuration for movement on rails 400 and 402 which are affixed inside the housing 382. The car 372, as shown in FIG. 9, has a similar configuration. Additionally, the cars 362 and 364 for hold-down member 312 are identically configured. By this technique, movement of the cables will effectuate parallel linear movement along the rails, thereby moving the associated bar in a position over one edge of the stack of slab goods.

As shown in FIGS. 8–10, up and down movement of each hold-down bar is effectuated by means of an air piston, for example, air piston assemblies 404 and 406 associated with bar 310 and a corresponding series of air cylinder 408 for bar 312. As shown in FIGS. 8–10, for example, the bar 310 has two extension members 410 and 412 which are journaled for movement in slots 414 in the plate 390. A corresponding extension and slot is shown relative to hold-down member 312, and each car has associated with it the slot as shown.

Referring to FIGS. 9 and 10, it can be seen that extension of the cylinder 404 will cause the extension 410 to raise in channel 414, thereby lifting the hold-down member 310 into a position which is above and displaced from the stack of slab goods. Hence, by appropriate actuation of the cylinders 404 and 406, a coordinated raising and outward movement of the hold-down member 310 may take place to allow the carriage to move to the edge of the slab pile, thereby performing cut near that periphery. As shown in FIG. 8, a corresponding movement for bar hold-down member 312 is accomplished by means of parallel cylinders 408.

The afore and aft movement of the cars 362, 364, 370 and 372 together with coordinated up and down motion of the air cylinders is accomplished under computer control in the cutting sequence.

Because the computer accurately knows the position of the goods when they are brought into the cutting area on belt 20—that is, by precise advancement of the belt relative to the known reference corner—the hold-down bars 310 and 312 may be moved by actuation of cylinders 314 and 340 to position the cars 362, 364, 370 and 372 at the peripheral edges of the stack of plies. The air cylinders associated with the raising of the bars 310 and 312 may then be released, allowing those weights to depress on the stack. The carriage 300 then traverses over the cutting are, and as it nears one of the hold-down bars, selective actuation of the air cylinders 404–408 and 314, 340 will raise and retract the bars into a position above the carriage to allow it to complete the cut in that vicinity of the stack of plies. The cars 362 and 364 can be manually moved by releasing lock members 366 to manually set the cars vis-a-vis the edge of the stack.

Referring again to FIGS. 2 and 3, it can be seen that once the cutting sequence is completed, belts 20 and 44 are actuated to move the cut material off of the cutting surface into the off-load area 16. Prior to actuation of belt 20, clamps 314 and 316 are raised, thereby releasing the belt 20 from its clamp onto the frame of the cutter system. Off-load belt 44 is actuated to effectuate a smooth transfer of material from belt 20. The off-load belt is generally driven at the same time the belt 20 is advanced so that material is introduced as cut materials are removed.

Referring again to FIGS. 1 and 4, a systematic overview of the operation of the system can be reviewed. Data for operation of the cutting system is initially defined in terms of a cut data input generated off-line and supplied to the system computer controller. Cut data input identifies the type of material to be used, the finish to be attained, various sizes with quantities, etc. which are all used in the generation of a production scheduling analysis. Availability of raw material and the like is used to generate the required scheduling that dictates the sequence of cutter operations. As indicated, the real time marker-making system has stored in it the necessary programming to generate markers indicative of maximum number of parts of a given configuration that may be cut in the maximum rectangle of any particular stack of plies. The generation of the marker is done on a near real time basis based on inputs from the measurements to be taken at the measurement section 10 of the system. Information as to the type of material, the number of plies and the particular instruction to be completed are transmitted by the computer controller to the operator console 14 and displayed on the display device 18 as shown in FIG. 4. The operator will then, with the frame 68 raised, load a ply of material corresponding to the material code onto the measurement area with the reference bars 54 and 56 in an upright position to determine and define a zero reference corner. A measurement instruction will then be issued, the frame lowered and the cursors moved. Measurements are taken in the manner when the cursors are positioned at the edges of the ply as described with respect to FIGS. 5 and 6. The frame 68 is raised and a second ply is loaded until all plies as required in a particular cut to be made have been loaded and measured.

When all the measurements have been completed, a marker is generated in real time about 0.5–1.5 minutes, depending on marker size, as the belt 20 is actuated to load material into the cutter section. While this batch of plies is being cut, the loading of raw material for the generation of a new marker will be performed in the measurement section. In the cutter station, as indicated, high-pressure water, if fluid jet cutting is used, will be channeled to the cutter by means of the tower and movable arm system. Fluid jet cutting will commence in a manner consistent with that described herein, utilizing a cutting head assembly mounted on carriage 300.

During this operation, control of the cutting operation is also monitored by the operator by a number of monitoring lights and push-button controls.

For example, the "emergency stop" button (FIG. 4) will cause an immediate shut-down of the positioning system and immediately turn off all cutting operations. To restart cutting, the positioning system will have to be reactuated in a 0—0 position, and the cutting of that marker will then be repeated utilizing the "continue" button. Following a stopping of the system by the "emergency stop" button, the "restart" button will be enabled and is used to repeat the marker currently being cut with a new set of measurements.

A depression of the "halt" cut button will allow a program stop to be manually commanded. The positioning system can then be manually slewed, and when the continue button is depressed, the positioning system will return the nozzle assembly to the last point of cutting, automatically lower the head and initiate a fluid jet cutting step.

The "material abort" button, when depressed, will signal the marker system that the particular material is temporarily unavailable. That is, if the operator cannot load the material required by the material code, that material cut is to be aborted, and the operator can achieve this function by depressing the "material abort" switch on his control panel. The marker system will then automatically proceed to instructions for cutting the next group of materials. When the next material change is reached, the marker system will automatically go back to the aborted material and request it again. If still not available, the operator can then depress the "material abort" switch and proceed to the next material. The system is programmed such that if the operator continues to repeatedly depress the "material abort" switch, the marker system will step through each material sequence and go on to the next new material to be cut.

The "ready" button shown on the cutter control portion allows the operator to signal the computer controller that its functions are complete and a new series of cutting can take place whenever the computer controller is ready. The computer controller will not begin a new cutting sequence prior to the ready button being depressed. The "material change" acknowledge button is a check on the operator that he has recognized that the marker system has informed him that a different material is to be loaded. The display panel utilizes a ten-digit display to signal the material type to be loaded, and a single digit to display the number of plies of material. Hence, when a material change is called for—that is, a new ten-digit code displayed—the "material change" acknowledge button will require the operator to acknowledge that he is aware of this material change.

Various other lamps are used to provide the operator with an indication of system operation. For example, the "fault" indicator 102 shows that a system malfunction has occurred, and the "labeler low-empty" button will indicate that labels which are to be applied to each cut piece from a labeler associated with the carriage is low or out. Details of that labeler are disclosed in the applicants' copending application Ser. No. 895,199, filed Apr. 10, 1978, and entitled "Real Time Labeler System." In essence, labels are generated on a real time basis from the computer control having identifying indicia of the part number which has been cut, and those labels are deposited on the cut pieces as the cutting sequence commences.

Depression of the "belt advance inhibit" switch will stop the advance motion of the conveyor belt bed 20. At any time during the advancement of material from measurement section 10 to the cutting section 12, the operator may inhibit the advance of the belt by depression of the inhibit switch. This is generally used when off-loading lags behind material advance into the cut station.

Accordingly, it is apparent that this system has three separate functions which are tied into systematic operation for individual measurement of a number of plies of raw materials in the form of slab goods, a second area for cutting and a third area for off-loading. While cutting and off-loading proceed in their respective areas, measurement of a new stack of plies proceeds in the measurement area. As that measurement is complete and the cutting operation is terminated, a new batch of plies are transmitted into the cutting area for cutting and a new series of plies are loaded into the measurement area for generation of a new marker.

It is readily apparent that changes to the specific equipment can be made without departing from the essential scope of this invention.

It is apparent that operation on the "A" subsystem operates independent of the "B" system except for interface at the real time marker-making system. Hence, tasks such as measuring, cutting and the like proceed independently in both subsystems.

We claim:

1. A method of cutting component parts from a slab comprising the steps of:

placing at least a first slab in a first measurement device and measuring the dimensions of said first slab;

transmitting the dimensions to a marker-making device for generating a marker;

transporting at least said first slab from said first measurement device to a first cutting device while generating the marker in the time interval of transportation; and cutting at least said first slab in said first cutting device using the generated marker to define the patterns to be cut in said slab.

2. The method of claim 1 further comprising the steps of:

loading a second slab in said first measurement device after the dimensions of said first slab have been transmitted;

measuring the dimensions of said second slab;

transmitting the dimensions of said second slab to said marker-making device; and transporting said first and second slabs to said first cutting device.

3. The method of claim 2 wherein said marker is generated in response to said measurements of said first and second slabs.

4. The method of claim 2 wherein said second slab is placed on top of said first slab in said first measurement device.

5. The method of claim 4 wherein said first cutting device cuts said first and second slabs simultaneously.

6. The method of claim 1 wherein said slab is placed in a reference corner in said first measurement device.

7. The method of claim 6 wherein said slab is transported from said first measurement device without any displacement in orientation from its placement in said reference corner.

8. The method of claim 1 further comprising the steps of placing said second slab in said first measurement device, and measuring the dimensions of said second slab while said first slab is being cut in said first cutting device.

9. The method of claim 8 further comprising the steps of transporting said second slab to said first cutting device while simultaneously off-loading component parts cut from said first slab, and generating a marker for said second slab.

10. The method of claim 1 further comprising the steps of placing a second slab in a second measurement device, and measuring the dimensions of said second slab.

11. The method of claim 10 further comprising the step of transmitting the dimensions of said second slab to said marker-making device.

12. The method of claim 11 further comprising the step of transporting said second slab from said second measurement device to a second cutting device while generating the marker for said second slab.

13. The method of claim 12 further comprising the step of cutting said second slab on said second cutting device.

14. A system for cutting slab goods comprising:

first means for measuring the dimensions of a slab to be cut;

means receiving said dimensions and generating a marker;

first cutting means using said marker to cut said slab into component parts; and means common to said first measurement means and said first cutting means for moving said slab precisely to said first cutting means without relative movement between said slab and said moving means, and wherein said marker is generated when said slab is being moved.

15. The system of claim 14 further comprises means associated with said first measuring means to accommodate a stack of slabs.

16. The system of claim 14 wherein said first cutting means comprises a fluid jet cutter.

17. The system of claim 14 further comprising means to off-load component parts.

18. The system of claim 14 further comprising second means for measuring the dimensions of a slab to be cut, and second cutting means and second means common to said second measuring means and said said second cutting means for moving a second slab precisely to said second cutting means without relative movement between said second slab and said second moving means, and wherein marker generator receives dimensions from said first and second measuring means.

* * * * *

UNITED STATES PATENT AND TRADEMARK OFFICE

CERTIFICATE OF CORRECTION

PATENT NO. : 4,186,632

DATED : February 5, 1980

INVENTOR(S) : Elmer N. Leslie, Bobby Higgins and Joe T. Huff

It is certified that error appears in the above-identified patent and that said Letters Patent are hereby corrected as shown below:

Column 10, line 39, after "control", insert --78 or 80--.
Column 11, line 24, change "wll" to --will--.
Column 12, line 34, after "Referring", insert --now--.
Column 20, line 13, change "measurement" to --measuring--
.

Signed and Sealed this

*Twenty-ninth* Day of *July 1980*

[SEAL]

*Attest:*

SIDNEY A. DIAMOND

*Attesting Officer*

*Commissioner of Patents and Trademarks*